US009109800B2

(12) United States Patent
Auzelyte et al.

(10) Patent No.: US 9,109,800 B2
(45) Date of Patent: Aug. 18, 2015

(54) QUICK DISENGAGING FIELD JOINT FOR EXHAUST SYSTEM COMPONENTS OF GAS TURBINE ENGINES

(75) Inventors: Ramune Auzelyte, Houston, TX (US); Christopher Conrad Frese, Greer, SC (US); Bradly Aaron Kippel, Greenville, SC (US); Jeffrey Patrick Mills, Greenville, SC (US)

(73) Assignee: General Electric Company, Schenectady, NY (US)

( * ) Notice: Subject to any disclaimer, the term of this patent is extended or adjusted under 35 U.S.C. 154(b) by 974 days.

(21) Appl. No.: 13/275,382

(22) Filed: Oct. 18, 2011

(65) Prior Publication Data

US 2013/0091864 A1 Apr. 18, 2013

(51) Int. Cl.

| | |
|---|---|
| ***F02C 7/20*** | (2006.01) |
| ***B23P 6/00*** | (2006.01) |
| ***F23J 13/04*** | (2006.01) |
| ***F23J 13/08*** | (2006.01) |
| *F01D 25/30* | (2006.01) |

(52) U.S. Cl.

CPC *F23J 13/04* (2013.01); *F23J 13/08* (2013.01); *F01D 25/30* (2013.01); *F23J 2213/204* (2013.01); *Y10T 29/49238* (2015.01)

(58) Field of Classification Search

CPC ..... F02C 7/20; F02C 7/24; F02C 7/32; F01D 25/24; F01D 25/28; F01D 25/243; F01D 25/26; F01D 25/30; F02K 1/04; F02K 1/80; F02K 1/822; F05D 2240/90; F05D 2240/91; F05D 2260/30; Y10T 29/00

See application file for complete search history.

(56) References Cited

U.S. PATENT DOCUMENTS

| | | | | |
|---|---|---|---|---|
| 4,109,924 | A | 8/1978 | Stucke | |
| 4,840,026 | A * | 6/1989 | Nash et al. | 60/770 |
| 6,176,526 | B1 * | 1/2001 | McRae et al. | 285/61 |
| 2003/0072648 | A1 * | 4/2003 | Han et al. | 415/119 |
| 2009/0252599 | A1 * | 10/2009 | Cavagnaro et al. | 415/119 |
| 2011/0140372 | A1 | 6/2011 | Buttell et al. | |

FOREIGN PATENT DOCUMENTS

| | | | |
|---|---|---|---|
| EP | 1995415 | A1 | 11/2008 |
| WO | 2007132408 | A2 | 11/2007 |

OTHER PUBLICATIONS

Search Report and Written Opinion from EP Application No. 12188731.9 dated Feb. 4, 2013.

* cited by examiner

*Primary Examiner* — Phutthiwat Wongwian
*Assistant Examiner* — Filippo Manfredi
(74) *Attorney, Agent, or Firm* — Dority & Manning, P.A.

(57) ABSTRACT

A quick disengaging field joint connects a first component of an exhaust system of a gas turbine engine to a second component of the exhaust system. The field joint includes a pair of opposed stepped liners connected via exterior-facing connecting flanges. The field joints can be disassembled entirely from outside the exhaust housing without requiring access to the interior of the exhaust housing.

19 Claims, 6 Drawing Sheets

FIG. —2—

QUICK DISENGAGING FIELD JOINT FOR EXHAUST SYSTEM COMPONENTS OF GAS TURBINE ENGINES

FIELD OF THE INVENTION

The subject matter disclosed herein generally involves joints that interface between components exposed to high gas flow volumes at high temperature and in particular to joints between components of the duct work of gas turbine engines.

BACKGROUND OF THE INVENTION

Periodic inspections of a gas turbine engine require the disassembly and subsequent re-assembly of various heat-insulating duct work that surrounds various components of the gas turbine engine. For example, before the rotor can be removed for inspection, various exhaust system components, including for example such heat-insulating duct work like the cowl, the forward plenum wall and other components, first need to be disassembled and removed to allow access to the gas turbine rotor. Each component of the heat-insulating duct work of the exhaust system of a gas turbine engine defines an internal liner having an exposed surface for facing the hot exhaust gases that flow through the exhaust system during operation of the engine. Each such component defines an external shell that is spaced apart from and opposes the internal liner and is exposed to the ambient atmosphere. Each such component includes a heat resistant insulation that is disposed in the space between the internal liner and the external shell. The surface of the external shell that faces the ambient atmosphere is the so-called shielded surface.

Removal of these heat-insulating duct work components requires disassembly of the field joints that connect these exhaust system components to one another. Typical of the field joints that one finds connecting the exhaust system components are either those of the so-called hot flange design or those of the so-called cold flange design.

Exhaust systems employing the so-called hot flange design are provided with the capped/encapsulated insulation and require the site personnel to perform external work during the disassembly/reassembly of the components of the exhaust system. Such hot flange design causes the flange to be directly exposed to the hot exhaust gas, which typically attains temperatures of ranging from around 900 deg F. to 2,000 deg F. Due to the temperature difference between the high temperature exhaust gas within the exhaust system components and the far lower ambient temperature external to the exhaust system components, the thermal stresses on the flanges at the field joints between such components cause cracks and other heat-induced distortions in the flanges as well as fatigue in the bolts joining the flanges. Such degradations in the field joints reduce the useful life expectancy of the exhaust system components and pose potential safety hazards due to increased incidence of exhaust gas leaking through such degraded field joints.

Exhaust systems employing the so-called cold flange design are provided with internal insulation and a floating liner system that protects the flanges from being directly exposed to the high temperature exhaust gas flowing inside the components of the exhaust system. However, assembly and disassembly of the field joints of the exhaust system components employing this so-called cold flange exhaust system design with the internal liner system requires the site personnel to perform work both inside the exhaust system housing and outside of the exhaust system housing. Such work inside the exhaust system housing requires the erection of scaffolding inside the exhaust system housing. Such inside and outside work assignments significantly increase the required disassembly-reassembly time relative to exhaust systems employing the so-called hot flange design.

BRIEF DESCRIPTION OF THE INVENTION

Aspects and advantages of the invention are set forth below in the following description, or may be obvious from the description, or may be learned through practice of embodiments of the invention.

One embodiment of the invention includes a quick disengaging field joint for connecting the free edge of a first component of an exhaust system of a gas turbine engine to the free edge of a second component of the exhaust system, uses a pair of opposed stepped liners connected via exterior-facing connecting flanges. Each stepped liner encapsulates the insulation and prevents the exterior-facing connecting flanges from being directly exposed to the exhaust gas. The field joints of this embodiment of the invention can be disassembled entirely from outside the exhaust housing without requiring access to the interior of the exhaust housing.

In a further embodiment, at least one of the stepped liners is segmented to include at least a first segment connected to at least a second segment and is free floating to allow for thermal growth without introducing thermal stresses.

In yet a further embodiment, at least one of the stepped liners is connected to the shell plate of the component via a retainer clip to allow the shell plate to expand freely.

In alternative embodiments of the quick disengaging field joint, one or more gaskets are strategically placed between the opposed stepped liners to further ensure against exposure of the flanges to radiant heat. A suitable gasket is typically glass fiber with or without an expanded metal core and can be coated with heat resistant material. The gasket may be a flat gasket or a gasket with a tadpole shape, i.e., a cylindrical part attached to a flat part, with the gasket's flat part used to fix the gasket between the opposing exterior-facing connecting flanges and between the stepped liners. If the gasket is disposed between the opposed stepped liners, the bolting hardware will act as a gasket stop to ensure that the gasket is not over compressed. Such bolting hardware can include rivets or self-tapping screws that hold the gasket in place along the length of the joint.

Another embodiment of the invention includes a gas turbine engine outfitted with opposed stepped liners connected via exterior-facing connecting flanges as quick disengaging field joints for connecting at least a pair of components of an exhaust system of the engine.

Another embodiment of the invention includes a method of retrofitting a gas turbine engine with opposed stepped liners connected via exterior-facing connecting flanges as quick disengaging field joints for connecting at least a pair of components of an exhaust system of the engine.

Another embodiment of the invention includes a method of disassembling at least a pair of heat-insulating duct work components of a gas turbine engine outfitted with opposed stepped liners connected via exterior-facing connecting flanges as quick disengaging field joints.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
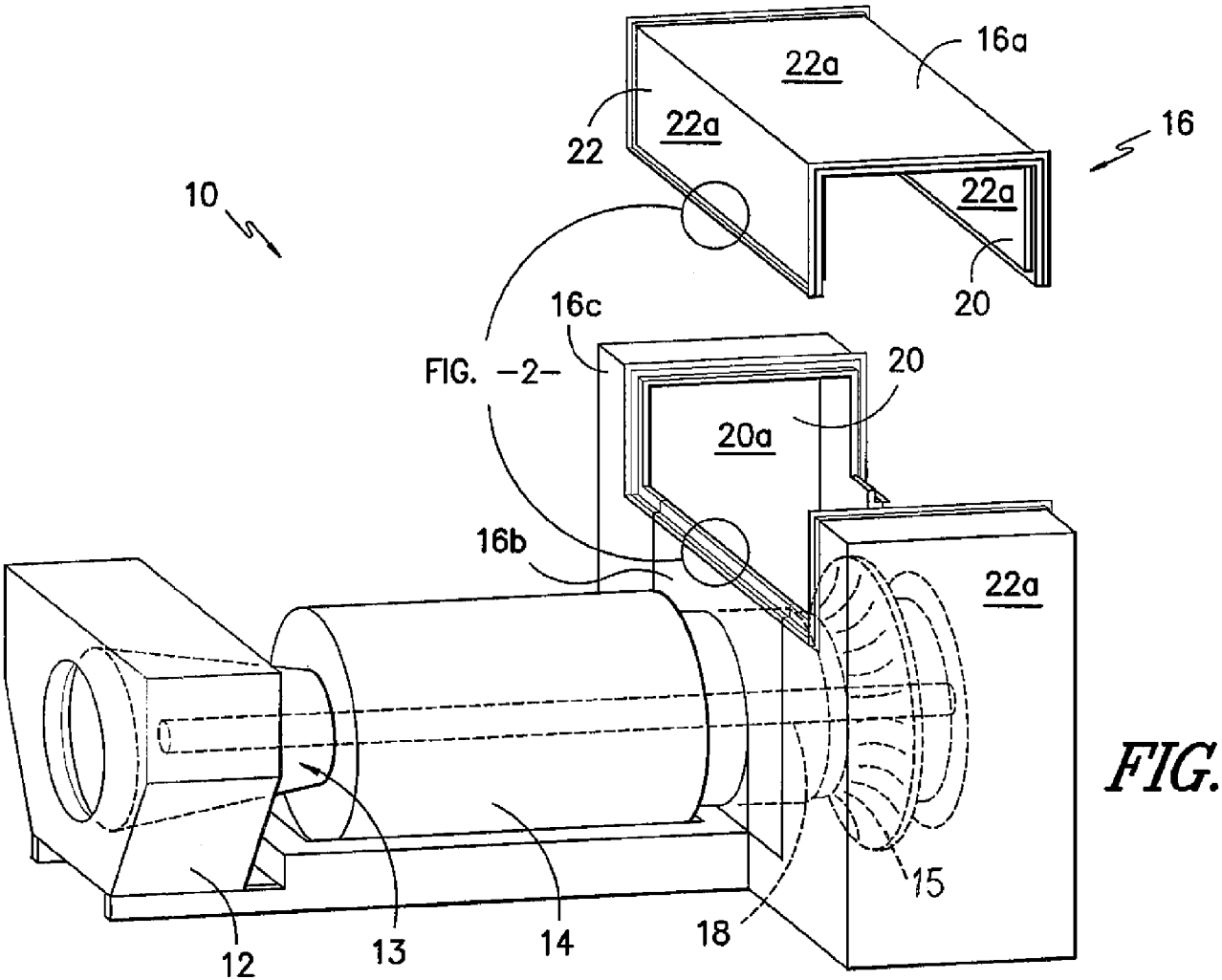
FIG. 1 is an elevated perspective view of a schematic representation of a gas turbine engine with a component of an embodiment of an exhaust housing removed.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

It is to be understood that the ranges and limits mentioned herein include all sub-ranges located within the prescribed limits, inclusive of the limits themselves unless otherwise stated. For instance, a range from 100 to 200 also includes all possible sub-ranges, examples of which are from 100 to 150, 170 to 190, 153 to 162, 145.3 to 149.6, and 187 to 200. Further, a limit of up to 7 also includes a limit of up to 5, up to 3, and up to 4.5, as well as all sub-ranges within the limit, such as from about 0 to 5, which includes 0 and includes 5 and from 5.2 to 7, which includes 5.2 and includes 7.

FIG. 1 schematically depicts a gas turbine engine 10, which typically includes an air inlet 12 that is in fluid communication with a compressor 13, which in turn is in fluid communication with a combustor 14. The combustor 14 in turn is in fluid communication with an exhaust housing that receives the gases that have passed through the turbine and the diffuser 15, which is hidden from view and indicated in phantom (dashed line) as is the turbine's shaft 18 that runs the length of the engine 10. The housing, which is generally designated by the numeral 16, includes various heat-insulating duct work components that must be disassembled and re-assembled to perform maintenance work on the engine 10. As schematically shown in FIG. 1, the diffuser 15 is disposed within the exhaust housing 16, which at least partially surrounds the turbine's shaft 18.

The exhaust housing 16 typically includes several removable components that must be disassembled and removed from the stationary components of the housing 16 to allow inspections and maintenance of items disposed inside the housing such as the diffuser 15 or the bearings supporting the turbine's shaft rotor 18. After completion of the desired inspections and/or maintenance, these removable components of the housing 16 must be reassembled. As shown schematically in FIG. 1 for example, such removable components of the exhaust housing 16 might include a cowl 16*a*, a plenum wall 16*b*, and a side wing 16*c*.

An embodiment of the invention includes a quick disengaging field joint for connecting these components that one finds in various accessory systems of a gas turbine engine 10, whether connecting removable components to stationary components or to other removable components of such accessory systems such as the exhaust housing 16. An embodiment of the invention includes gas turbines engines with such accessory systems such as the exhaust housing 16 outfitted with or retrofitted with such quick disengaging field joints. An embodiment of the invention includes a method of disassembling such accessory systems such as the exhaust housing 16 of a gas turbine engine. An embodiment of the invention includes a method of retrofitting such accessory systems such as the exhaust housing 16 of a gas turbine engine with one or more quick disengaging field joints as disclosed herein.

Figure 2:
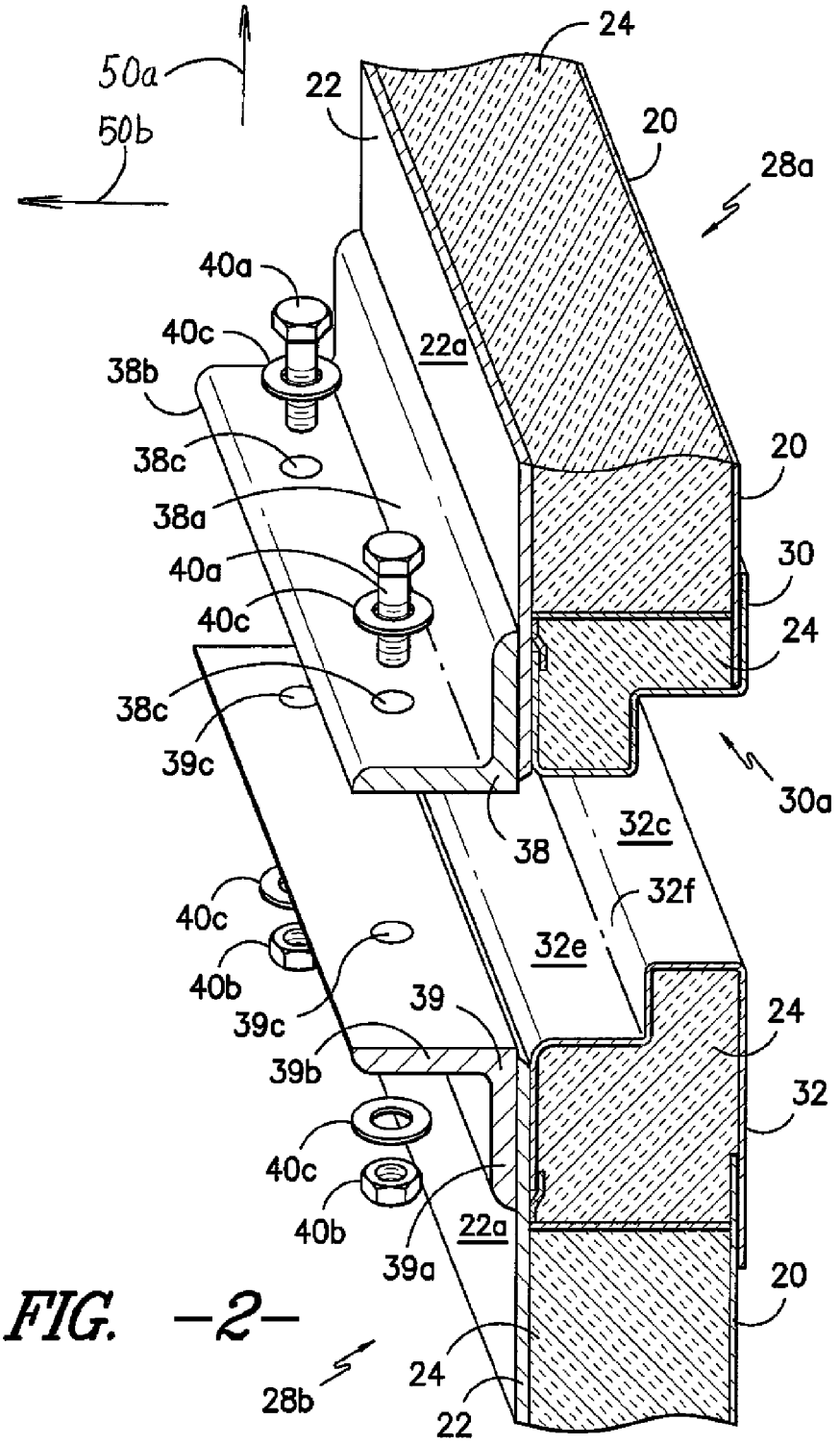
FIG. 2 is an exploded view of the balloons outlined in FIG. 1 depicting an embodiment of the disassembled field joint between separated components of the exhaust housing shown in FIG. 1 from a perspective view in part and from a cross-sectional view in part.
Figure 3:
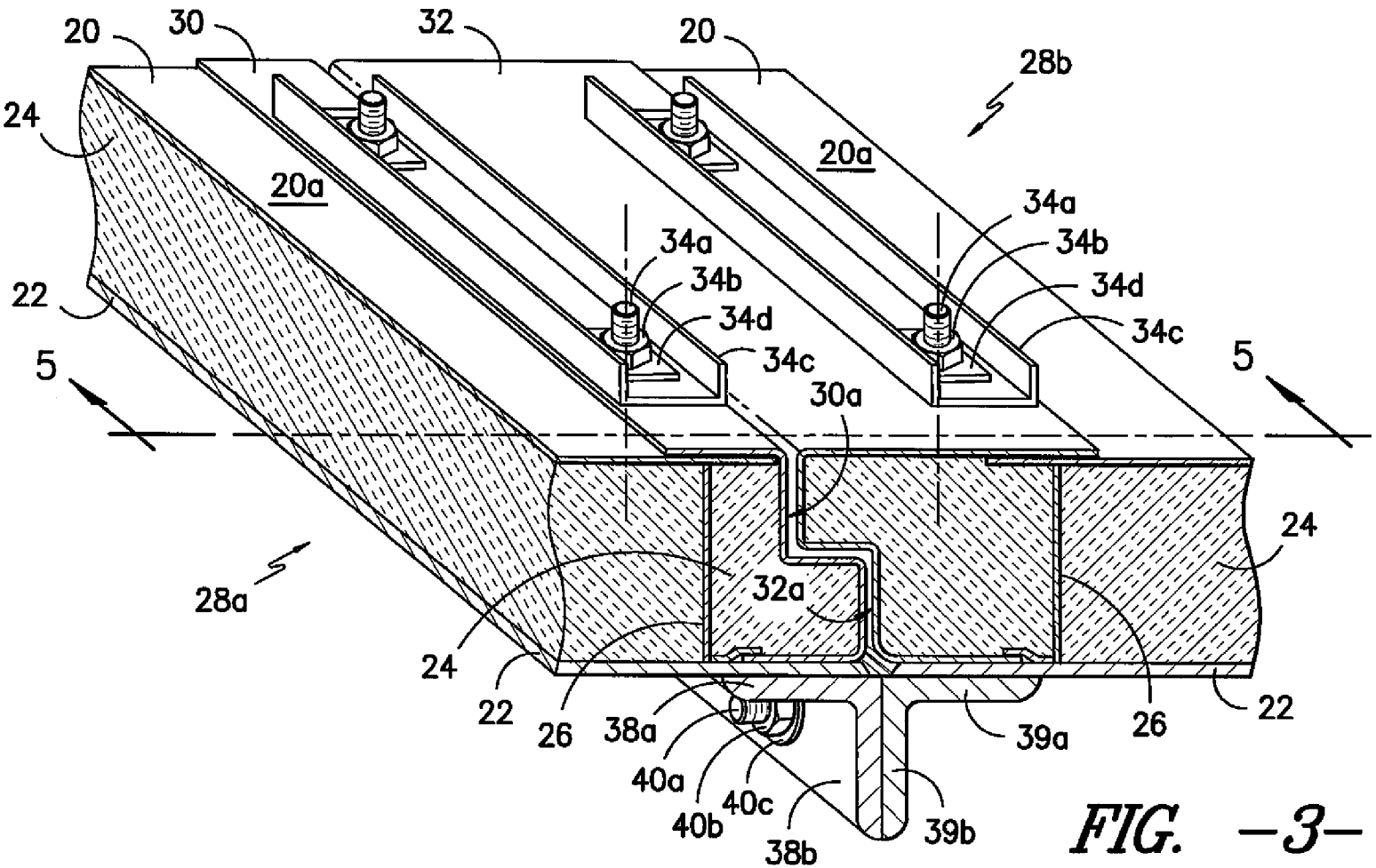
FIG. 3 is a view similar to the view of FIG. 2 but from a different perspective and shown with the joint connected.

As schematically shown in FIGS. 1-3, each component composing ducting wall construction of the exhaust housing 16 defines an internal liner 20, which often is known as the so-called floating liner. As schematically shown in FIGS. 1 and 3, the internal liner 20 defines a surface 20*a* that is opposite the surface facing the external shell 22 and the insulation 24 and is referred to herein as the so-called exposed surface 20*a* because it is the liner surface that faces the hot exhaust gases that flow within the exhaust housing 16. The internal liner 20 desirably is formed of high temperature stainless steel sheet metal, which desirably has a thickness of about one eighth inch (3.175 millimeters).

As schematically shown in FIGS. 1-3, each component of the exhaust housing 16 defines an external shell 22 that is spaced apart from and opposes the internal liner 20. As schematically shown in FIGS. 1 and 2, the surface of the shell 22 that is opposite the surface facing the internal liner 20 is referred to herein as the so-called shielded surface 22*a* and is the surface that faces the ambient atmosphere. The external shell 22 desirably is formed of metal such as carbon plate steel, which desirably has a thickness of about one quarter inch (6.35 millimeters).

As schematically shown in FIG. 2, each component includes a heat resistant insulation 24 that is disposed in the space between the internal liner 20 and the external shell 22. The distance that separates the internal liner 20 from the external shell 22 and that is filled with thermal insulation 24 will vary depending on the design criteria for the components and typically ranges between about one inch (2.54 cm) and ten inches (25.40 cm) and all sub-ranges therebetween. However, for purposes of the remaining description, that space is assumed to be about four inches (10.16 cm). The thermal insulation 24 typically is provided in blanket form as one or more layers, but for purposes of simplicity the insulation 24 is depicted herein as a continuum between the internal liner 20 and the external shell 22. The thermal insulation can include materials such as one or more of ceramic fiber, calcium magnesium silicate, mineral wool, basalt fiber, and the like.

Figure 6:
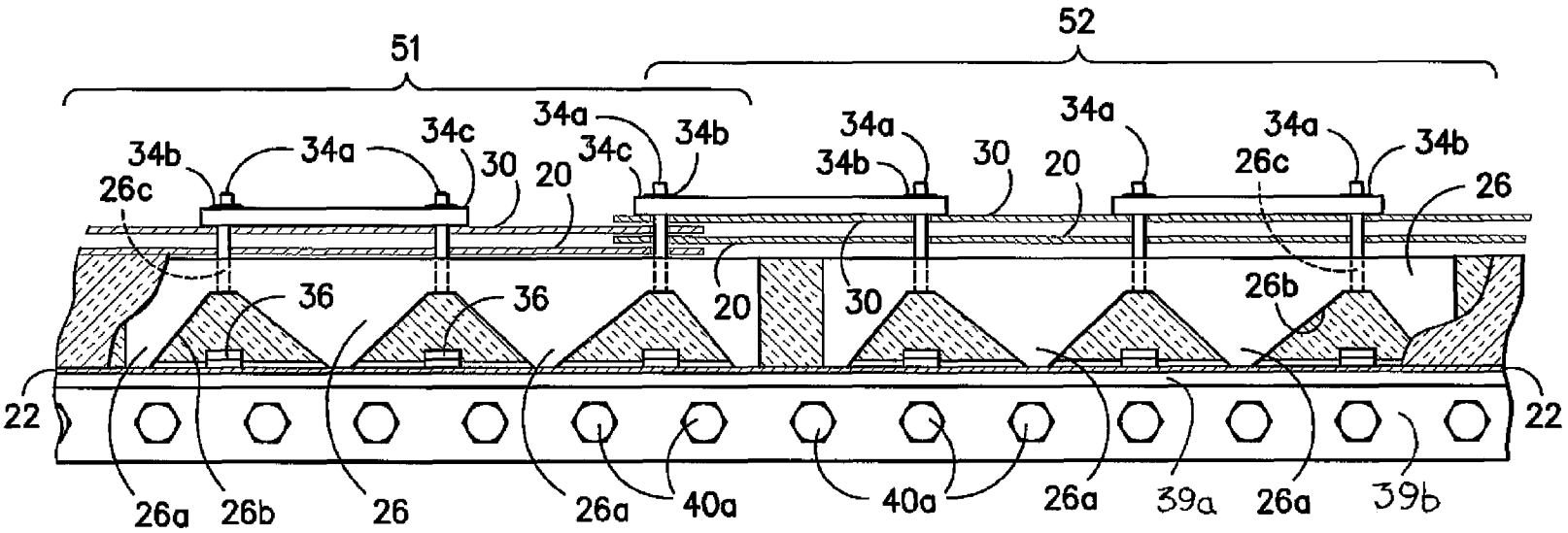
FIG. 6 is a cross-sectional view taken along the lines of 6-6 in FIG. 5.

As schematically shown in FIGS. 3 and 6 for example, a scallop plate 26 desirably is disposed internally of each component of the exhaust housing and extends between the internal liner 20 and the external shell 22 of the each component. In accordance with the assumption made above about the thickness of each component, the height of each scallop plate is about four inches (10.16 cm). The length of each scallop plate can vary. However, each scallop plate 26 desirably runs about four feet (122 cm) in length (the dimension into the page in the view of FIG. 3 and across the page in the view of FIG. 6), and that will be the assumption of the present description. Each scallop plate 26 desirably is formed of high temperature stainless steel and desirably has a thickness of about one eighth inch (3.175 millimeters).

As schematically shown in FIG. 6 for example, depending on the length of the component of the exhaust system 16, more than one scallop plate 26 may be included. As schematically shown in FIG. 6, a first scallop plate 26 runs down the length of one side of a first component of the exhaust housing 16 and a second scallop plate 26 is spaced apart from the first scallop plate 26 and continues the run down the length of one side of the first component of the exhaust housing 16. As schematically shown in FIG. 3, a scallop plate 26 is disposed near the free end of each of a first component 28*a* of the exhaust housing 16 and a second component 28*b* of the exhaust housing 16.

As schematically shown in FIG. 6, each scallop plate 26 defines a plurality of foot sections 26*a*, and each foot section 26*a* desirably is welded to the carbon steel shell 22 of each component of the exhaust housing 16. As schematically shown in FIG. 6, each foot section 26*a* is spaced apart from each adjacent foot section 26*a* in each scallop plate 26 and defines a cutout section 26*b* therebetween. Above the apex of each cutout section 26*b*, each scallop plate 26 defines a bridge section 26*c*. In alternative embodiments, the cutout sections 26*b* can be eliminated.

Figure 4:
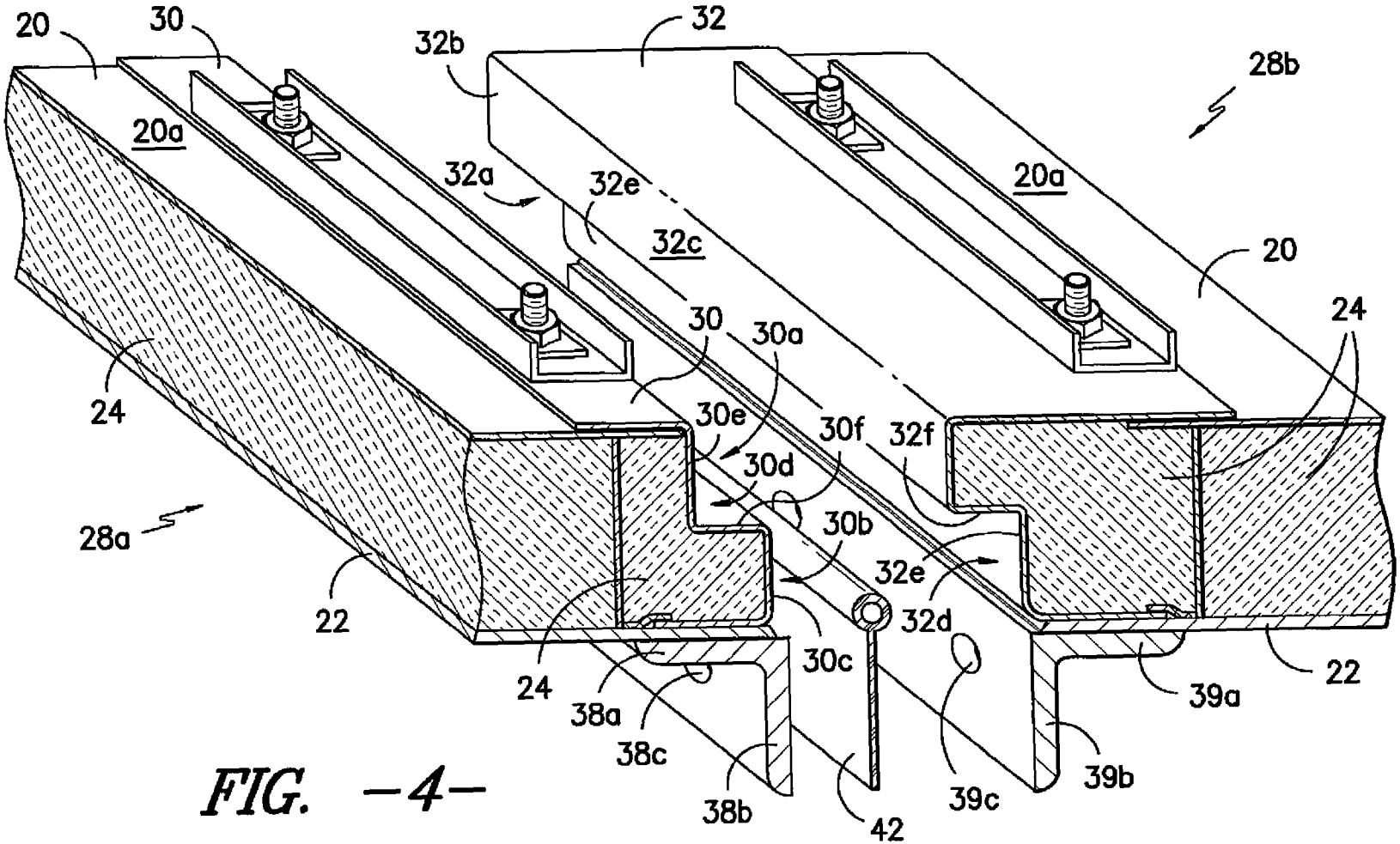
FIG. 4 is a view similar to the view of FIG. 2 but of an alternative embodiment shown with the joint disconnected and from a different perspective.

Embodiments of the quick disengaging field joint are designed to attach the free end of a first component of the exhaust housing 16 to the free end of a second component of the exhaust housing 16. FIG. 4 schematically depicts a section of the interface at the free end of a first component 28*a* of the exhaust housing 16 that is spaced apart from a section of the interface at the free end of a second component 28*b* of the exhaust housing 16. In the description that follows, in cases in which both the first and second components (e.g., the cowl 16*a* and plenum wall 16*b*) of the exhaust housing 16 will be removed from the rest of the exhaust housing 16 during some part of the maintenance procedure, it is assumed that the first component 28*a* (e.g., cowl 16*a*) is a component of the exhaust housing 16 that is going to be removed during disassembly in advance of the removal of the second component 28*b* (e.g., plenum wall 16*b*). Moreover, in some instances the second component 28*b* (e.g., side wing 16*c*) will not need to be removed in order to access the interior of the exhaust housing 16 for the desired inspection and/or maintenance, and thus the second component 28*b* (e.g., side wing 16*c*) will remain stationary and connected to the rest of the gas turbine engine 10 at all times during the inspection and/or maintenance procedure. Thus, if both components are removable, this description assumes that the second component 28*b* is the portion of the exhaust housing 16 that is going to be removed from the exhaust housing 16 during disassembly after the first component 28*a* has been removed as for example the plenum wall 16*b* will be detached from the exhaust housing 16 after the cowl 16*a* is detached in the depiction of FIG. 1.

As schematically shown in FIG. 4 for example, an embodiment of the quick disengaging field joint includes an interface in the form of a first joint liner 30 disposed at the free edge of a first component 28*a* of the exhaust housing 16. As shown in FIG. 4 for example, the first joint liner 30 defines a first stepped end 30*a*. As shown in FIG. 4 for example, an embodiment of the quick disengaging field joint includes an interface in the form of a second joint liner 32 disposed at the free edge of the second component 28*b* of the exhaust housing 16. As shown in FIG. 4 for example, the second joint liner 32 defines a second stepped end 32*a* that is configured to mirror the shape of first stepped end 30*a* of the first joint liner 30. Thus, each component 28*a*, 28*b* has an interface that is joined to form an embodiment of a quick disengaging field joint, and each interface of each component 28*a*, 28*b* is defined by a stepped end 30*a*, 32*a* that mirrors stepped end 30*a*, 32*a* of the opposing interface that forms the joint between the two components 28*a*, 28*b*.

Each of the first joint liner 30 and the second joint liner 32 desirably is formed of high temperature stainless steel sheet metal, which desirably has a thickness of about one eighth inch (3.175 millimeters). Each of the first joint liner 30 and the second joint liner 32 desirably can be formed by welding or by bending a sheet of the metal measuring about four feet (122 cm) in length (the dimension extending into the page in the views of FIGS. 2-5 and across the page in the view of FIG. 6). Accordingly, the full length of any component of the exhaust housing 16 may include individual segments of the required number of these four foot long sections joined end-to-end as explained more fully below. Moreover, sheets measuring more or less than four feet in length may be used to form the first joint liner 30 and the second joint liner 32, as required by the size of the component involved. In each case, each of the joint liners 30, 32 desirably can be segmented in this manner to include at least a first segment connected to at least a second segment and with each segment anchored to the respective internal liner 20 of the respective component 28*a*, 28*b*.

As schematically shown in FIG. 4 for example, the first stepped end 30*a* defines a first overhang portion 30*b* that is disposed closer to the external shell 22 of the first component 28*a*, and the first overhang portion 30*b* defines a front face 30*c*. The first stepped end 30*a* further defines a first undercut portion 30*d* disposed closer to the internal liner 20 of the first component 28*a*, and the first undercut portion 30*d* defines a rear face 30*e*. The first stepped end 30*a* of the first joint liner 30 defines a common face 30*f* extending between and joining the front face 30*c* of the first overhang portion 30*b* and the rear face 30*e* of the first undercut portion 30*d*. The other dimension of the metal sheet that is to be bent to form the joint liners 30, 32 will depend on the thickness of the component 28*a*, 28*b* and the number of steps at the free end of the component. Assuming that the thickness of the embodiment of the first component 28*a* depicted in FIG. 4 is about four inches (10.16 cm), then the other dimension (shown in cross-section in FIG. 4) of the metal sheet used to form the first joint liner 30 desirably would measure about twelve and one half inches (31.75 cm), assuming that the steps were the same size. In this example, each of the front face 30*c* of the first overhang portion 30*b*, the rear face 30*e* and the common face 30*f* measures about two inches (5.08 cm), the portion overlapping the internal liner 20 measures about three and one half inches (8.89 cm) and the rearward section 30*g* measures about three inches (7.62 cm).

As schematically shown in FIG. 4 for example, the second stepped end 32*a* defines a second overhang portion 32*b* disposed closer to the internal liner 20 of the second component 28*b*, and the second overhang portion 32*b* defines a front face 32*c*. The second stepped end 32*a* further defines a second undercut portion 32*d* disposed closer to the external shell 22 of the second component 28*b*, and the second undercut portion 32*d* defines a rear face 32*e*. The second stepped end 32*a* of the second joint liner 32 defines a common face 32*f* extending between and joining the front face 32*c* of the second overhang portion 32*b* and the rear face 32*e* of the second undercut portion 32*d*. Assuming that the thickness of the embodiment of the second component 28*b* depicted in FIG. 4 is about four inches (10.16 cm), then the other dimension (shown in cross-section in FIG. 4) of the metal sheet used to form the second joint liner 32 desirably would measure about fourteen and one half inches (36.83 cm), assuming that the steps were the same size. In this example, each of the front face 32*c* of the second overhang portion 32*b*, the rear face 32*e* and the common face 32*f* measures about two inches (5.08 cm), the portion overlapping the internal liner 20 measures about five and one half inches (13.97 cm) and the rearward section 32*g* measures about three inches (7.62 cm).

As shown in FIG. 3 for example, the front face of the first overhang portion is disposed opposite the rear face of the second undercut portion. The front face of the second overhang portion is disposed opposite the rear face of the first undercut portion. The common face of the first stepped end of the first joint liner is disposed opposite the common face of the second stepped end of the second joint liner. Desirably, the common face of the first stepped end of the first joint liner is disposed normal to the front face of the first overhang portion of the first joint liner. Desirably, the common face of the second stepped end of the second joint liner is disposed normal to the rear face of the second undercut portion of the second joint liner. However, the shape of steps forming the stepped ends 30*a*, 32*a* need not be orthogonal so long as the first stepped end 30*a* and the second stepped end 32*a* are shaped as mirror images of one another and satisfy the constraint that permits the first component 28*a* (the first moving component) to be separated and taken away from the second component 28*b* of the exhaust housing 16 as for example shown schematically in FIG. 1 in which the cowl 16*a* is being separated from the plenum wall 16*b* and the side wing 16*c*.

While the embodiments illustrated herein include a single so-called step, more than a single step can be provided. The number of steps can be increased to accommodate components that are thicker than four inches to provide increased space for additional thermal insulation 24 between the external shell 20 and the internal liner 20. For example two steps, three steps, four steps, etc. can be provided by bending this number of steps into the metal sheets that are used to form the joint liners 30, 32. Moreover, in some embodiments, the relative sizes of each of the steps can be varied so that one or more steps is/are sized differently than the one or more of the other steps.

Figure 5:
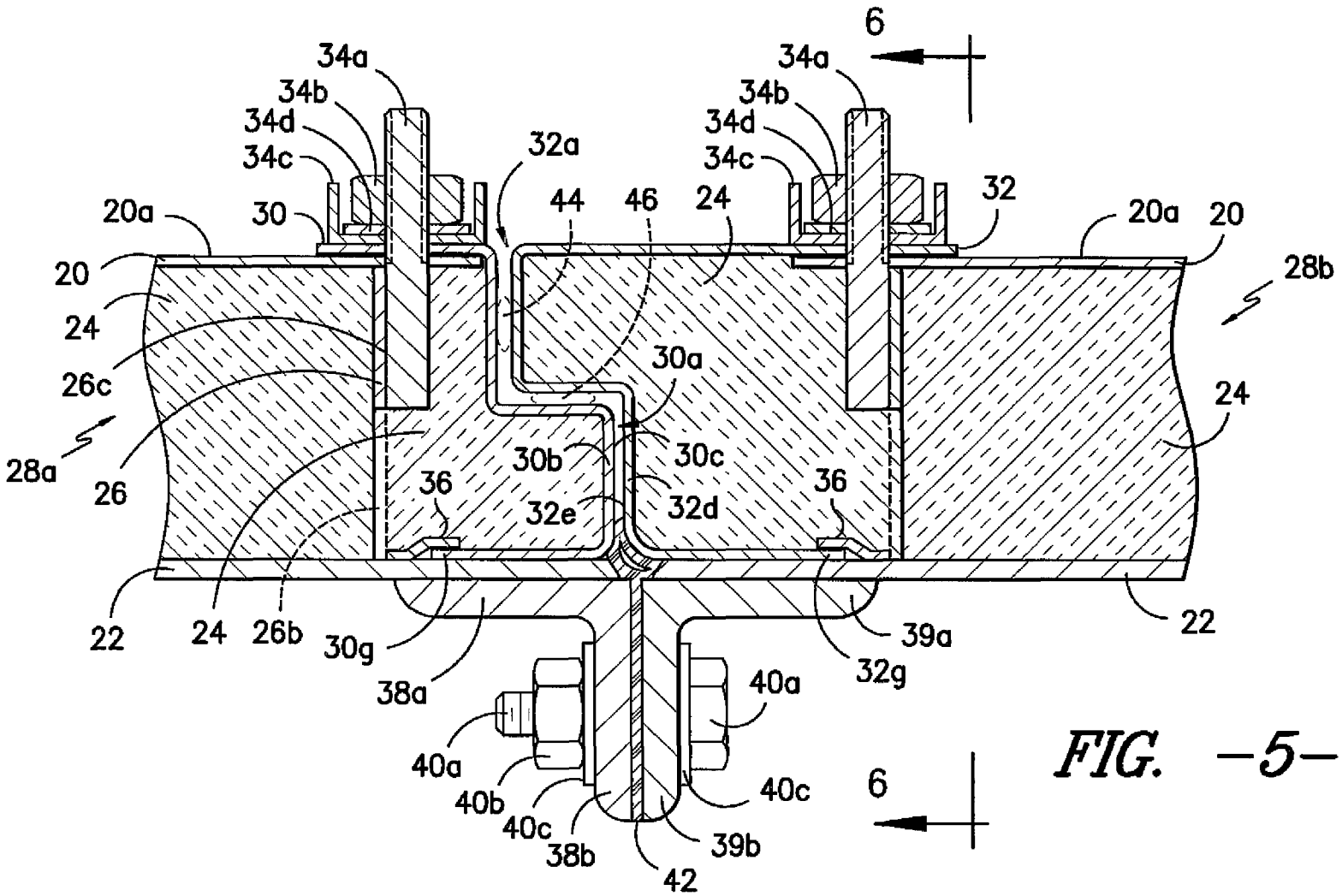
FIG. 5 is a cross-sectional view similar to that of the lines designated 5-5 in FIG. 3 with the joint connected but taken of the embodiment shown in FIG. 4, which shows the joint disconnected.

As shown in FIGS. 3 and 5 for example, an embodiment of the quick disengaging field joint includes a first fastener anchoring the first joint liner 30 to the internal liner 20 of the first component 28*a* of the exhaust housing 16 so that the exposed surface 20*a* of the first joint liner 20 is facing the inside of the exhaust housing where the hot gases would be flowing during operation of the gas turbine engine 10. Similarly, a second fastener anchors the second joint liner 32 to the internal liner 20 of the second component 28*b* of the exhaust housing 16. Desirably, each of the first and second fasteners is a high temperature fastener. As shown in FIG. 5 for example, each of the first and second fasteners desirably includes a stud 34*a* that has a length that is long enough so that it can be installed with about half of the length of the stud 34*a* disposed above the joint liners 30, 32 and about half its length disposed below the liners 30, 32. A stud 34*a* that measures at least four inches (10.16 cm) will suffice if the thickness of the component is about the same distance. Each stud 34*a* desirably is formed as a cylindrical rod made of high temperature stainless steel that is threaded on one end to receive a high temperature stainless steel nut 34*b*. Alternatively, a welded pin and washer could be used as the fastener instead of a threaded stud and nut arrangement.

As shown in FIG. 5 for example, each of the first and second fasteners desirably includes a threaded nut 34*b*, a clamp bar 34*c* and a washer 34*d*. The threaded end of the stud 34*a* desirably can be received through openings in a clamp bar 34*c* and a washer 34*d* disposed between the clamp bar 34*c* and the nut 34*b*. As noted above, a welded pin and washer could be used as the fastener instead of a threaded stud 34*a*, a threaded nut 34*b*, a clamp bar 34*c* and a washer 34*d* arrangement. Though only a U-shaped clamp bar 34*c* is depicted in FIGS. 2-5, the clamp bar 34*c* alternatively can be formed as an L-shaped bar or a flat bar, etc., as the case may be. Each clamp bar 34*c* desirably is formed of high temperature stainless steel such as stainless sheet metal having a thickness of about one eighth inch (3.175 millimeters). Though only a rectangular-shaped washer 34*d* is depicted in FIGS. 2-5, the peripheral shape of the washer 34*d* alternatively can be in any shape, including circular. Desirably, the washer 34*d* is tack welded to the nut 34*b* and to the clamp bar 34*c*.

As schematically shown in FIG. 5 for example, the opposite end of the stud 34*a* desirably is welded to one of the bridge sections 26*c* of the scallop plate 26 of the component 28*a*, 28*b* of the exhaust housing 16. Desirably, assuming that the thickness of the component 28*a*, 28*b* is about four inches, at least two inches of the stud 34*a* is welded to the bridge section 26*c* of the scallop plate 26. As schematically shown in FIGS. 5 and 6 for example, the scallop plate 26 of the first component 28*a* runs lengthwise in a direction generally parallel to the first joint liner 30. Similarly, the second scallop plate 26 of the second component runs lengthwise in a direction generally parallel to the second joint liner 32.

Figure 7:
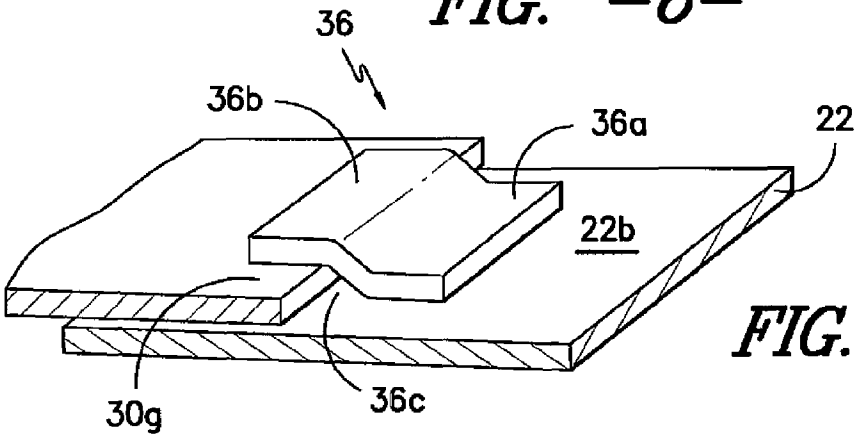
FIG. 7 is an elevated perspective view of a schematic representation of a retainer clip.

As schematically shown in FIGS. 4 and 5 for example, an embodiment of the quick disengaging field joint includes at least a first retainer clip 36. Each retainer clip 36 desirably is formed of high temperature stainless steel such as eleven gauge (having a thickness of about one eighth inch or 3.175 millimeters) stainless steel sheet metal. As embodied herein and schematically shown in FIG. 7 for example, each retainer clip 36 desirably is configured as a Z-shaped clip that has a rear end 36*a* connected mechanically as by welding to the inward-facing surface 22*b* of the external shell 22 of the first component 28*a*. As schematically shown in FIGS. 5 and 6 for example, the at least a first retainer clip 36 desirably is disposed beneath the bridge section 26*c* at the apex of one of the cutout sections 26*b* of the scallop plate 26. As schematically shown in FIG. 7 for example, the at least a first retainer clip 36 has a forward end 36*b* that is disposed sufficiently above the inside facing surface 22*b* of the external shell 22 so as to define a slot 36*c* between the forward end 36*b* of the first retainer clip 36 and the external shell 22. A rearward section 30*g* of the first joint liner 30 that is disposed away from the first stepped end 30*a* of the first joint liner 30 is slideably received by the first retainer clip 36 in this slot 36*c* so formed. Similarly, as schematically shown in FIG. 5 for example, at least a second retainer clip 36 is connected to the external shell 20 of the second component 28*b* and slideably receives a rearward section 32*g* of the second joint liner 32 that is disposed away from the second stepped end 32*a* of the second joint liner 32. Alternatively, each retainer clip 36 can be shaped so that each of the forward end 36*b* and the rear end 36*a* makes a right angle connection to the segment that joins the forward end 36*b* to the rear end 36*a*. In a further alternative embodiment of the retainer clip 36, the rear end 36*a* can be eliminated, and the forward end 36*b* can be disposed at a right angle to form an inverted L-shaped clip with the base of the vertically extending section of the L-shaped clip welded to the inward-facing surface 22*b* of the external shell 22.

As schematically shown in FIG. 6 for example, a plurality of retainer clips 36 desirably is provided so that one retainer clip 36 is disposed generally beneath each bridge section 26*c* at each apex of each of each cutout section 26*b* of the scallop plate 26 of the component 28*a*, 28*b* of the exhaust housing 16. In this way, the first joint liner 30 is free to expand into the slots 36*c* provided between forward end 36*b* of the first retainer clip 36 and the inside facing surface 22*b* of the external shell 20. Similarly, the second joint liner 32 is free to expand into the slots 36*c* provided between forward end 36*b* of the second retainer clip 36 and the inside facing surface 22*b* of the external shell 20. This construction renders the stepped liner sheets 30, 32 free floating to allow for thermal growth without introducing thermal stresses. Moreover, connecting the stepped liners 30, 32 to the shell plate 22 via a retainer clip 36 in this manner allows the shell plate 22 to expand freely.

As schematically shown in FIGS. 2-4 for example, an embodiment of the quick disengaging field joint includes at least a first connecting flange 38 that is attached to the shielded surface 22*a* of the external shell 22 of the first component 28*a*. The first connecting flange 38 desirably is configured with a first base 38*a* that is attached mechanically as by welding to the shielded surface 22*a* of the external shell 22 of the first component 28*a*. The first connecting flange 38 desirably defines a first connecting plate 38*b* extending from the first base 38*a* and defining a plurality of openings 38*c* therethrough, each such opening being configured for receiving a connecting bolt 40*a*. Desirably, each of the first base 38*a* and the first connecting plate 38*b* of the first connecting flange 38 defines a surface that is perpendicular to the other.

Desirably, as schematically shown in FIGS. 2 and 5 for example, the second connecting flange 39 is configured identically as the first connecting flange 38. Accordingly, an L-angle metal bar or two metal plates welded together to form an L-angle desirably can be used to form each connecting flange 38, 39. Thus, at least a second connecting flange 39 is defined by a second base 39*a* that is attached mechanically as by welding to the shielded surface 22*a* of the external shell 22 of the second component 28*b* and further defines a second connecting plate 39*b* extending from the second base 39*a* and defining a plurality of openings 39*c* therethrough, each such opening being configured for receiving a connecting bolt 40*a*. As schematically shown in FIG. 5 for example, the connecting plate 38*b* of the first connecting flange 38 desirably is disposed opposite the connecting plate 39*b* of the second connecting flange 39. Each opening 38*c* through the connecting plate 38*b* of the first connecting flange 38 desirably is aligned with one of the openings 39*c* through the connecting plate 39*b* of the second connecting flange 39.

As schematically shown in FIGS. 2, 3 and 5 for example, an embodiment of the quick disengaging field joint includes a third fastener joining the first connecting flange 38 to the second connecting flange 39. The third fastener desirably is provided by a structural fastener and desirably includes a bolt 40, a threaded nut 40*b* and a pair of washers 40*c*. The bolt 40*a* desirably is disposed through the opening 38*c* through the connecting plate 38*b* of the first connecting flange 38 and an aligned opening 39*c* through the connecting plate 39*b* of the second connecting flange 39. As schematically shown in FIG. 2 for example, one end of the bolt 40*a* of the third fastener desirably is configured with a head, and a first washer 40*c* desirably is disposed between the head and the connecting plate 39*b* of the first connecting flange 38. One end of the bolt 40*a* opposite the head desirably is threaded to receive a threaded nut 40*b*, and a second washer 40*c* desirably is disposed between the nut 40*b* and the connecting plate 39*b* of the second connecting flange 39. Moreover, as schematically shown in FIG. 5 for example, each bolt 40*a* and nut 40*b* can be attached next to the connecting plate 38*b* of the first connecting flange 38. Alternatively, the flanges 38, 39 can be joined by welding or by a combination of welding and bolting.

When the third fastener is applied to connect the quick disengaging field joint as schematically shown in FIGS. 3 and 5 for example, the distance between the axial centerlines of each pair of adjacent studs 34*a* desirably is about six inches (15.24 cm). In the view shown in FIG. 6 for example, the distance between the axial centerlines of each pair of adjacent studs 34*a* desirably is about twelve inches (30.48 cm). When the field joint has been connected with the opposing flanges 38, 39 tightly flush against each other as schematically shown in FIG. 5 for example, the spacing between the mirrored surfaces of the first stepped end 30*a* of first stepped liner 30 and the second stepped end 32*a* of the second stepped liner 32 desirably is on the order of three millimeters. However, as schematically shown in FIGS. 3 and 5 for example, this distance between the mirrored surfaces 30*c*, 32*e*, 30*e*, 32*c* 30*f*, 32*f* of the first stepped liner 30 and the second stepped liner 32 has been exaggerated for purposes of ease of illustration. Moreover, other spacings between the stepped liners 30, 32 in a range of 1 mm to 7 mm are contemplated, depending on the design criteria.

As schematically shown in FIGS. 2-5 for example, each of the joint liners 30, 32 is configured and connected to the respective component 28*a*, 28*b* of the exhaust housing 16 so as to encapsulate the insulation 24 of the respective component 28*a*, 28*b* and prevent during operation of the gas turbine engine 10 the exterior-facing connecting flanges 38, 39 from being directly exposed to the exhaust gas that flows through the exhaust housing 16 and against where the internal liner 20 connects to the joint liners 30, 32. Moreover, as schematically shown in FIG. 4 for example, the stepped liner sheets are segmented and free floating to allow for thermal growth without introducing thermal stresses. As explained more fully below, in order to ensure a gas tight seal between the mirrored surfaces of the first stepped end 30*a* of first stepped liner 30 and the second stepped end 32*a* of the second stepped liner 32, gaskets can be disposed between them if the spacing between the mirrored surfaces of the first stepped end 30*a* of first stepped liner 30 and the second stepped end 32*a* exceeds a design spacing, e.g., three millimeters in some embodiments.

As schematically shown in FIG. 6 for example, the metal sheets forming the stepped liners 30, 32 are segmented and free floating to allow for thermal growth without introducing thermal stresses. As noted above, each of the first joint liner 30 and the second joint liner 32 desirably is provided at the free edge of its respective component 28*a*, 28*b* in sections measuring about four feet (122 cm) in length, which is the left to right direction in FIG. 6. FIG. 6 schematically represents a component 28*a* or 28*b* that measures more than four feet in length and thus would require joining at least two of the liner sections end-to-end to form say a first joint liner of a first component. As schematically shown in FIG. 6, where the ends of the two linearly adjoining sections come together to form say a first component, there will be four thicknesses of the liner plate stacked one on top of the other beneath the clamp bar 34*c*.

As schematically shown in FIG. 6, a first section 51 of the first component 28*a* includes a first four foot length section of a first joint liner 30 disposed on top of a first four foot length section of a first internal liner 20. The empty space between the first four foot length section of the first joint liner 30 and the internal liner 20 is exaggerated for purposes of ease of explanation. But in reality, there would be no space between them because the nuts 34*b* (partially obscured from view in FIG. 6) would be tightened onto the stud 34*a* against the washer 34*d* and clamp bar 34*c* to press the two liners 30, 20 (or four liners 30, 30, 20, 20) against each other. Similarly, as schematically shown in FIG. 6, a second section 52 of the first component 28*a* includes a second four foot length of a first joint liner 30 disposed on top of a second four foot section of a first internal liner 20. Again, the empty space between the second four foot length section of the first joint liner 30 and the second four foot section of a first internal liner 20 is exaggerated for purposes of ease of explanation, as the nuts 34*b* would be tightened onto the stud 34*a* against the washer 34*d* and clamp bar 34*c* to press the two liners 30, 20 (or four liners 30, 30, 20, 20) against each other.

As schematically shown in FIG. 6, where these first and second sections 51, 52 of the first component come together in an overlapping manner, one end section of a first four foot length of a first joint liner 30 is disposed on top of an opposed end section of a second four foot length of a first joint liner 30. The opposed end section of the second four foot length of a first joint liner 30 is disposed on top of an end section of a first four foot section of a first internal liner 20. The end section of the first four foot section of the first internal liner 20 is disposed on top of the opposed end section of a second four foot section of a first internal liner 20.

As schematically shown in FIGS. 4 and 5 for example, an alternative embodiment of the quick disengaging field joint desirably includes a first gasket 42 that is disposed between the first connecting flange 38 and the second connecting flange 39. As schematically shown in FIGS. 4 and 5 for example, a first gasket 42 is disposed between the connecting plate 38*b* of the first connecting flange 38 and the connecting plate 39*b* of the second connecting flange 39. As schematically shown in FIGS. 4 and 5 for example, the bolt 40*a* of the third fastener desirably extends through a first section of the first gasket 42.

As schematically shown in FIGS. 4 and 5 for example, the first gasket 42 desirably is provided as a tadpole gasket, which includes a flat, ribbon-like portion extending from a hollow cylindrical portion that desirably has a diameter of about 1.5 inches (3.8 millimeters) when the spacing is about 3 mm. However, other size diameters of the cylindrical portion of the tadpole gasket will be used depending on the desired spacing between the stepped liners 30, 32. Suitable tadpole gaskets can be formed of fiberglass wound around a stainless steel core and coated with polytetrafluoroethylene (PTFE).

As schematically shown in FIGS. 4 and 5 for example, the first gasket 42 desirably is disposed with the flat section of the tadpole gasket being disposed between the connecting plate 38*b* of the first connecting flange 38 and the connecting plate 39*b* of the second connecting flange 39 and the bolt 40*a* of the third fastener extending through this flat first section of the tadpole gasket. As schematically shown in FIGS. 4 and 5 for example, the tadpole gasket desirably has at least a second section disposed between the first stepped end 30*a* of the first joint liner 30 and the second stepped end 32*a* of the second joint liner 32. Desirably, as schematically shown in FIGS. 4 and 5 for example, at least the second section of the tadpole gasket is disposed between the front face 30*c* of the first overhang portion 30*b* of the first joint liner 30 and the rear face 32*e* of the second undercut portion 32*d* of the second joint liner 32. The second section of the tadpole gasket desirably is a first portion of the cylindrical portion of the tadpole gasket. As schematically shown in FIG. 5 for example, the tadpole gasket desirably has at least a third section disposed between the free edge of the external shell 22 of the first component 28*a* and the free edge of the external shell 22 of the second component 28*b*. The third section of the tadpole gasket desirably is a second portion of the cylindrical portion of the tadpole gasket. When the field joint embodiment has been connected with the opposing flanges 38, 39 tightly flush against the first gasket 42 as schematically shown in FIG. 5 for example, the spacing between the mirrored surfaces of the first stepped end 30*a* of first stepped liner 30 and the second stepped end 32*a* of the second stepped liner 32 desirably is on the order of three millimeters. However, other spacings between the stepped liners 30, 32 in a range of 1 mm to 7 mm are contemplated, depending on the design criteria.

In an alternative embodiment schematically shown in FIG. 5 for example, the quick disengaging field joint desirably includes at least a first compressed wire mesh gasket 44 (shown in dashed line) disposed between the rear face 30*e* of the first undercut portion 30*d* of the first joint liner 30 and the front face 32*c* of the second overhang portion 32*b* of the second joint liner 32. As is the case with the tadpole gasket, first compressed wire mesh gasket 44 (shown in dashed line) runs the entire length of the rear face 30*e* of the first undercut portion 30*d* of the first joint liner 30 and the front face 32*c* of the second overhang portion 32*b* of the second joint liner 32. Moreover, the first compressed wire mesh gasket 44 (shown in dashed line) desirably is attached by rivets (not shown) or self-tapping screws (not shown) to one of the rear face 30*e* of the first undercut portion 30*d* of the first joint liner 30 or the front face 32*c* of the second overhang portion 32*b* of the second joint liner 32.

In an alternative embodiment schematically shown in FIG. 5 for example, the quick disengaging field joint desirably includes at least a second compressed wire mesh gasket 46 (shown in dashed line) disposed between the common face 30*f* of the first stepped end 30*a* of the first joint liner 30 and the common face 32*f* of the of the second stepped end 32*a* of the second joint liner 32. As is the case with the tadpole gasket, second compressed wire mesh gasket 44 (shown in dashed line) runs the entire length of the common face 30*f* of the first stepped end 30*a* of the first joint liner 30 and the common face 32*f* of the of the second stepped end 32*a* of the second joint liner 32. Moreover, the second compressed wire mesh gasket 44 (shown in dashed line) desirably is attached by rivets (not shown) or self-tapping screws (not shown) to one of the common face 30*f* of the first stepped end 30*a* of the first joint liner 30 and the common face 32*f* of the of the second stepped end 32*a* of the second joint liner 32.

In an alternative embodiment schematically shown in FIG. 5 for example, the quick disengaging field joint desirably includes both a first compressed wire mesh gasket 44 (shown in dashed line) and at least a second compressed wire mesh gasket 46 (shown in dashed line).

In an alternative embodiment schematically shown in FIG. 5 for example, the quick disengaging field joint desirably includes both at least a tadpole gasket 42, at least a first compressed wire mesh gasket 44 (shown in dashed line), and at least a second compressed wire mesh gasket 46 (shown in dashed line). Moreover, other embodiments can include additional gaskets (42, 44, 46), as for example when more than one step is formed in each stepped liner 30, 32.

In a further embodiment of the invention, a method is provided for retrofitting a gas turbine engine 10 having an exhaust system 16 that includes at least a pair of components (e.g., cowl 16*a*, plenum wall 16*b*) that are joined together by at least one conventional field joint, whether of the so-called hot flange design or the so-called cold flange design. In accordance with an embodiment of this method, each of the conventional field joints connecting at least a pair of components of the exhaust system of the engine is disassembled. Once the conventional field joints are disassembled, at least one of the components with the disassembled field joints is removed from the exhaust system of the engine. Then on the removed component, the interface that forms one half of the field joint is itself removed from that at least one component that was removed from the exhaust system of the engine. On each of the components from which at least one interface of the field joint was removed from the component of the exhaust system of the engine, a replacement interface is installed that includes at least one opposed stepped liner as described above. These actions can be repeated for each of the components of the exhaust system or for fewer than each of those components, as the situation warrants.

Referring to FIGS. 1 and 2 for example, once components of the exhaust system 16 of a gas turbine engine 10 are fitted with one of the embodiments of the quick disengaging field joint, it becomes possible to perform a labor-saving and time-saving method of preparing a gas turbine engine 10 for internal inspection and/or maintenance within the exhaust housing 16 that includes at least a pair of components 28*a*, 28*b* connected by at least one field joint and exterior-facing flanges 38, 39 connected by at least one fastener. Moreover, due to the embodiments of the quick disengaging field joint, this labor-saving and time-saving method can be performed without disengaging any part of the housing 16 from inside the housing 16 where many of the inspections and/or maintenance procedures are needed. This labor-saving and time-saving method requires only external work on the component 28*a* that is to be separated from the rest of the components (e.g., 28*b*) and still provides a field joint that is robust enough to prevent the flanges 38, 39 of the joined components 28*a*, 28*b* from being directly exposed to the hot exhaust gas inside the exhaust housing 16 during operation of the gas turbine engine 10. Referring to FIG. 2 for example, to perform this labor-saving and time-saving method, one begins by removing each of the fasteners (e.g., bolts 40*a*, nuts 40*b* and washers 40*c*) from only the exterior-facing flanges 38, 39 of the components 28*a*, 28*b* connected at the quick disengaging field joint. Once the fasteners are removed, one then can remove at least one of the components 28*a* from the exhaust housing 16 of the engine 10. As schematically shown in FIG. 2 for example, removal can occur by moving the freed component 28*a* relative to the stationary component 28*b* in the direction within the plane of the field joint (indicated by the arrow designated 50*a*) or in the direction that is normal to the plane of the field joint (indicated by the arrow designated 50*b*). Additional components (e.g., 28*b*) can be removed as needed in order to gain the desired access for the required inspection and/or maintenance procedure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A quick disengaging field joint for connecting a free edge of a first component of an exhaust system of a gas turbine engine to the free edge of a second component of the exhaust system, each component including an internal liner having an exposed surface for facing the hot exhaust gases of the exhaust system, each component including an external shell having a shielded surface for facing the ambient atmosphere, each component including heat resistant insulation disposed between the internal liner and the external shell, the field joint comprising:

a. a first joint liner disposed at the free edge of the first component, the first joint liner defining a first stepped end;

b. a first fastener anchoring the first joint liner to the internal liner of the first component;

c. a second joint liner disposed at the free edge of the second component, the second joint liner defining a second stepped end that is configured to mirror the shape of first stepped end of the first joint liner; and d. a second fastener anchoring the second joint liner to the internal liner of the second component.

2. The quick disengaging field joint of claim 1, wherein the first stepped end defining a first overhang portion adjacent the external shell of the first component and defining a first undercut portion adjacent the internal liner of the first component, the first overhang portion defining a front face, the first undercut portion defining a rear face, the first stepped end of the first joint liner defining a common face extending between and joining the front face of the first overhang portion and the rear face of the first undercut portion.

3. The quick disengaging field joint of claim 2, wherein the second stepped end defining a second overhang portion adjacent the internal liner of the second component and defining a second undercut portion adjacent the external shell of the second component, the second overhang portion defining a front face, the second undercut portion defining a rear face, the second stepped end of the second joint liner defining a common face extending between and joining the front face of the second overhang portion and the rear face of the second undercut portion.

4. The quick disengaging field joint of claim 3, wherein the front face of the first overhang portion is disposed opposite the rear face of the second undercut portion, the front face of the second overhang portion is disposed opposite the rear face of the first undercut portion, and the common face of the first stepped end of the first joint liner is disposed opposite the common face of the second stepped end of the second joint liner.

5. The quick disengaging field joint of claim 4, wherein the common face of the first stepped end of the first joint liner is disposed normal to the front face of the first overhang portion of the first joint liner and wherein the common face of the second stepped end of the second joint liner is disposed normal to the rear face of the second undercut portion of the second joint liner.

6. The quick disengaging field joint of claim 1, further comprising at least a first retainer clip connected to the external shell of the first component and configured to slideably receive a section of the first joint liner that is disposed away from the first stepped end of the first joint liner.

7. The quick disengaging field joint of claim 6, further comprising at least a second retainer clip connected to the external shell of the second component and configured to slideably receive a section of the second joint liner that is disposed away from the second stepped end of the second joint liner.

8. The quick disengaging field joint of claim 1, wherein at least one of the first joint liner and the second joint liner is segmented into at least two segments anchored to the respective internal liner by the respective fastener.

9. The quick disengaging field joint of claim 1, further comprising:

a. at least a first connecting flange attached to the shielded surface of the external shell of the first component;

b. at least a second connecting flange attached to the shielded surface of the external shell of the second component; and c. a third fastener joining the first connecting flange to the second connecting flange.

10. The quick disengaging field joint of claim 9, further comprising:

a tadpole gasket, the tadpole gasket having at least a first section disposed between the first connecting flange and the second connecting flange, the tadpole gasket having at least a second section disposed between the first stepped end of the first joint liner and the second stepped end of the second joint liner, the tadpole gasket having at least a third section disposed between the free edge of the external shell of the first component and the free edge of the external shell of the second component.

11. The quick disengaging field joint of claim 10, wherein at least a second section of the tadpole gasket being further disposed between the front face of the first overhang portion and the rear face of the second undercut portion.

12. The quick disengaging field joint of claim 4, at least a first compressed wire mesh gasket disposed between the front face of the second overhang portion and the rear face of the first undercut portion, at least a second compressed wire mesh gasket disposed between the common face of the first stepped end of the first joint liner and the common face of the of the second stepped end of the second joint liner.

13. A quick disengaging field joint for connecting a pair of components of an exhaust system of a gas turbine engine, each component defining an internal liner having an exposed surface for facing the hot exhaust gases of the exhaust system, each component defining an external shell having a shielded surface for facing the ambient atmosphere, each component including heat resistant insulation disposed between the internal liner and the external shell, the field joint comprising:

a. first joint liner connected to a first one of the components so as to encapsulate the insulation of the respective component, the first joint liner defining a first stepped end, the first stepped end defining a first overhang portion adjacent the external shell of the first component and defining a first undercut portion adjacent the internal liner of the first component, the first overhang portion defining a front face, the first undercut portion defining a rear face, the first stepped end of the first joint liner defining a common face extending between and joining the front face of the first overhang portion and the rear face of the first undercut portion;

b. a first fastener anchoring the first joint liner to the internal liner of the first component;

c. at least a first retainer clip connected to the external shell of the first component and slideably receiving a section of the first joint liner that is disposed away from the first stepped end of the first joint liner;

d. a second joint liner connected to a second one of the components so as to encapsulate the insulation of the respective component, the second joint liner defining a second stepped end, the second stepped end defining a second overhang portion adjacent the internal liner of the second component and defining a second undercut portion adjacent the external shell of the second component, the second overhang portion defining a front face, the second undercut portion defining a rear face, the second stepped end of the second joint liner defining a common face extending between and joining the front face of the second overhang portion and the rear face of the second undercut portion;

e. a second fastener anchoring the second joint liner to the internal liner of the second component;

f. at least a second retainer clip connected to the external shell of the second component and slideably receiving a section of the second joint liner that is disposed away from the second stepped end of the second joint liner;

g. wherein the front face of the first overhang portion is disposed opposite the rear face of the second undercut portion, the front face of the second overhang portion is disposed opposite the rear face of the first undercut portion, and the common face of the first stepped end of the first joint liner is disposed opposite the common face of the second stepped end of the second joint liner;

h. at least a first compressed wire mesh gasket disposed between the rear face of the first undercut portion and the front face of the second overhang portion, at least a second compressed wire mesh gasket disposed between the common face of the first stepped end of the first joint liner and the common face of the second stepped end of the second joint liner;

i. at least a first connecting flange having a base attached to the shielded surface of the external shell of the first component, the first connecting flange defining a connecting plate extending from the base and defining an opening therethrough configured for receiving a connecting bolt;

j. at least a second connecting flange having a base attached to the shielded surface of the external shell of the second component, the second connecting flange defining a connecting plate extending from the base and defining an opening therethrough configured for receiving a connecting bolt, k. the connecting plate of the first connecting flange being disposed opposite the connecting plate of the second connecting flange, and the opening through the connecting plate of the first connecting flange being aligned with the opening through the connecting plate of the second connecting flange;

l. at least a first section of a tadpole gasket being disposed between the connecting plate of the first connecting flange and the connecting plate of the second connecting flange, at least a second section of the tadpole gasket being further disposed between the front face of the first overhang portion and the rear face of the second undercut portion, at least a third section of the tadpole gasket being further disposed between the free edge of the external shell of the first component and the free edge of the external shell of the second component; and m. a bolt disposed through the opening through the connecting plate of the first connecting flange, the first section of the tadpole gasket and the opening through the connecting plate of the second connecting flange.

14. A gas turbine engine, comprising:

a. an air inlet;

b. a compressor in fluid communication with the air inlet;

c. a combustor connected in fluid communication to the compressor;

d. a turbine in fluid communication with the combustor;

e. a diffuser in fluid communication with the combustor;

f. an exhaust housing connected in fluid communication with the combustor and containing the diffuser, the exhaust housing including at least a first component and at least a second component connected to the at least first component, each component including an internal liner having an exposed surface for facing hot exhaust gases that may pass through the diffuser in the exhaust housing, each component including an external shell having a shielded surface for facing the ambient atmosphere, each component including heat resistant insulation disposed between the internal liner and the external shell, the first component being configured to be selectively detachable from the second component and selectively removable from the exhaust housing; and g. a quick disengaging field joint for connecting at least the first component of the exhaust housing to at least the second component of the exhaust system, the field joint comprising:

i. a first joint liner connected to the first component, the first joint liner defining a first stepped end;

ii. a first fastener anchoring the first joint liner to the internal liner of the first component;

iii. a second joint liner connected to the second component, the second joint liner defining a second stepped end that is configured to mirror the shape of first stepped end of the first joint liner; and h. a second fastener anchoring the second joint liner to the internal liner of the second component.

15. The gas turbine engine of claim 14, wherein the first stepped end defining a first overhang portion adjacent the external shell of the first component and defining a first undercut portion adjacent the internal liner of the first component, the first overhang portion defining a front face, the first undercut portion defining a rear face, the first stepped end of the first joint liner defining a common face extending between and joining the front face of the first overhang portion and the rear face of the first undercut portion.

16. The gas turbine engine of claim 15, wherein the front face of the first overhang portion is disposed opposite the rear face of the second undercut portion, the front face of the second overhang portion is disposed opposite the rear face of the first undercut portion, and the common face of the first stepped end of the first joint liner is disposed opposite the common face of the second stepped end of the second joint liner.

17. The gas turbine engine of claim 14, further comprising:

a. at least a first connecting flange attached to the shielded surface of the external shell of the first component;

b. at least a second connecting flange attached to the shielded surface of the external shell of the second component; and c. a third fastener joining the first connecting flange to the second connecting flange.

18. The gas turbine engine of claim 14, further comprising at least a first retainer clip connected to the external shell of the first component and configured to slideably receive a section of the first joint liner that is disposed away from the first stepped end of the first joint liner.

19. The gas turbine engine of claim 14, wherein at least one of the first joint liner and the second joint liner is segmented into at least two segments anchored to the respective internal liner by the respective fastener.

* * * * *